US006464110B1

(12) United States Patent
Yamada

(10) Patent No.: US 6,464,110 B1
(45) Date of Patent: Oct. 15, 2002

(54) PERFUME DISPENSING IMPLEMENT

(75) Inventor: Hiromichi Yamada, Tokyo (JP)

(73) Assignee: Yamada Atomizer Company Limited, Tokyo (JP)

( * ) Notice: Subject to any disclaimer, the term of this patent is extended or adjusted under 35 U.S.C. 154(b) by 0 days.

(21) Appl. No.: 09/647,816

(22) PCT Filed: Feb. 10, 2000

(86) PCT No.: PCT/JP00/00753

§ 371 (c)(1),
(2), (4) Date: Oct. 31, 2000

(87) PCT Pub. No.: WO00/47079

PCT Pub. Date: Aug. 17, 2000

(30) Foreign Application Priority Data

Feb. 12, 1999 (JP) ..... 11-072421
Apr. 13, 1999 (JP) ..... 11-002406

(51) Int. Cl.[7] ..... B65D 25/48

(52) U.S. Cl. ..... 222/321.9; 222/385; 222/420; 222/567; 206/229

(58) Field of Search ..... 222/321.7, 321.9, 222/382, 385, 420, 567; 206/229; 220/23.86, 23.83

(56) References Cited

U.S. PATENT DOCUMENTS 2,639,806 A * 5/1953 Recht ..... 206/229
2,968,441 A * 1/1961 Holcomb ..... 222/402.1
3,058,584 A * 10/1962 Marshall ..... 206/229
3,379,196 A * 4/1968 Michell ..... 222/420
5,277,340 A * 1/1994 Van Brocklin ..... 222/385

* cited by examiner

*Primary Examiner*—Lesley D. Morris
*Assistant Examiner*—Patrick Buechner
(74) *Attorney, Agent, or Firm*—Frishauf, Holtz, Goodman & Chick, P.C.

(57) ABSTRACT

An implement enabling a user to positively split-inject various kinds of perfumes by a simple attaching/detaching operation is provided. The implement includes a multi-stage engaging unit 21 to be fitted to the outlet of a container 8 for storing therein perfume, a push-operation head 2 provided with an outlet hole opened at the center of the engaging unit 21, and a dispensing pipe 1 connected to the outlet hole, whereby it is possible to split-inject small amounts of perfumes for transfer into separate containers and carry a plurality of kinds of perfume.

2 Claims, 5 Drawing Sheets

PERFUME DISPENSING IMPLEMENT

FIELD OF THE INVENTION

The present invention relates to a perfume dispensing implement, and more particularly to an implement which enables a user to easily transfer a perfume from an original container to another container (hereinafter called "split-injection") by a simple attaching/detaching operation, and to a method for using new perfumes or the like.

BACKGROUND OF THE INVENTION

Fluid such as perfume or toilet lotion generally has some flow action and contains components which exhibit strong reactivity, and hence, the use of a glass container becomes inevitable. Further, when the resistance against rupture or the like is taken into account, the adoption of a container having some thickness becomes inevitable With respect to such perfume or toilet lotion, there have been various kinds of products depending on fragrance components. With respect to containers, which contain products, it has been general knowledge that the containers differ in shape and size and takeout portions of these containers also differ in shape, diameter and size depending on makers. To cope with such various kinds of products, containers and handling implements are prepared for respective products.

With respect to perfume or the like, the use of a glass container is inevitable as mentioned above and further the glass container must have a thick wall thickness in view of the resistance against rupture. Still further, the glass container must meet the aesthetic requirement. Accordingly, a peculiar shape or stereoscopic design is applied to the glass container including a cap and other parts. That is, in the glass container having such a thick wall thickness and such a design, the container per se becomes considerably large-sized and heavy compared to an inner volume thereof so that the glass container has ended up having a configuration which is not suitable for carrying while being accommodated in a handbag. That is, being a glass container, it has a hard material body and hence becomes bulky. Further, since the glass container must be carried together with other cosmetics and accessories, they become large in number and hence, it becomes difficult to carry the glass container while accommodating it in the handbag.

Further, even if the above-mentioned conventional containers for perfume or the like are recovered, it is difficult to clean and recycle them and hence, they have to be disposed of as waste. In this case, a disposal amount of the glass containers as a waste becomes remarkably large in terms of volume as well as weight compared to an amount of target perfume contained therein.

Further, the effective time of the above-mentioned perfume or the like is generally approximately 23 hours. That is the reason why, in a journey or the like, it is effective to use suitable perfumes which truly match morning, daytime, night or the atmosphere of a meeting place at least depending on respective situations. However, as mentioned above, under the condition that the container must be bulky and heavy, the carrying of one piece of glass container per se makes the handbag bulky and heavy and hence, the carrying of the container becomes inconvenient. Further, the carrying of a large number of glass containers gives rise to various troubles.

That is, since it is difficult to carry the glass containers, even if the glass container is carried, the number of glass containers is limited. Accordingly, it is impossible to provide the use of versatile perfumes, which are truly suitable for respective situations, so that a user has to be satisfied with the use conditions of perfumes at an unsatisfying level.

Accordingly, the typical manner of using this kind of perfume or the like is to prepare and display a plurality of perfumes which are contained in a plurality of bulky and heavy glass containers in a toilet room or the like and a user uses any one of the perfumes depending on the situation. However, such a use of perfumes is the use based on the toilet room and hence, there exists a limit with respect to the use of the perfumes in a journey by an automobile or a journey by a train. Although the user can make use of perfumes by a momentary operation with the use of a spray mechanism, such glass containers eventually bring about inconvenience and disadvantage in terms of their use.

SUMMARY OF THE INVENTION

The invention is directed to a perfume dispensing implement, which can be commonly used at an outlet of respective perfume containers by forming an engaging portion to be fitted into the outlets of the containers in which perfumes or toilet waters are stored in multiple stepped stages and connecting a dispensing pipe to a push operation head provided with an outlet hole which opens to a central portion of the engaging portion and the outlet.

Further, by storing the perfume dispensing implement and a cylindrical dispensing unit in a packaging and storing body, a container having excellent portability is obtained so that various kinds of perfumes or the like can be suitably and properly dispensed, and thereby, respective perfumes can be effectively and properly used under conditions of various kinds of journeys or meetings.

DETAILED DESCRIPTION

Figure 1A:
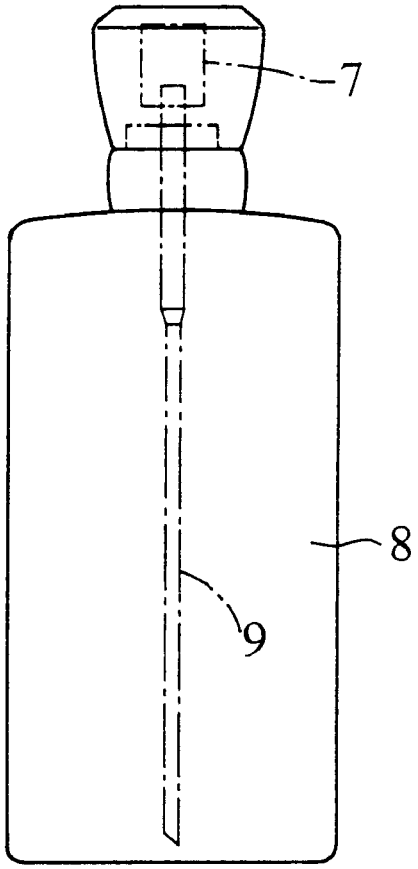
FIGS. 1(A) and 1(B) are front views showing one example of a commercially available perfume container, which adopts the invention.
Figure 1B:
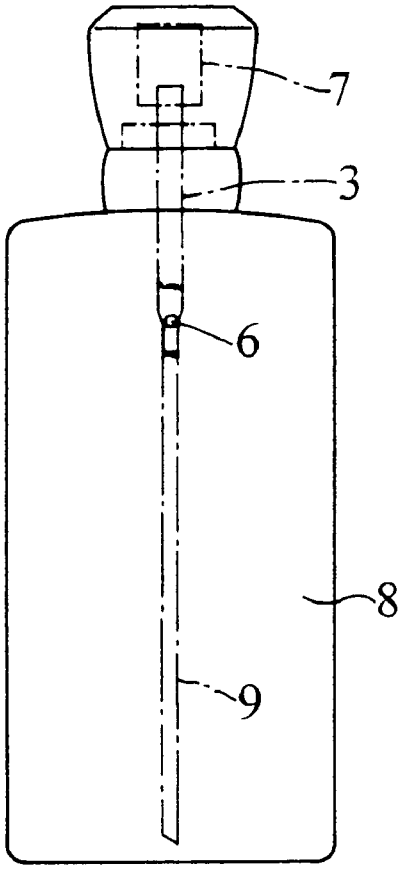

To explain the specific embodiment of the above-mentioned perfume dispensing implement of the present invention, which is shown in the attached drawings, as the above-mentioned perfume container, versatile containers have been adopted corresponding to respective makers and kinds of perfumes. A typical example is shown in FIGS. 1(A) and 1(B), wherein a contour of a piston pipe 3 which functions as an outlet in such a commercially available container is 3 mm–5 mm. On the piston pipe which belongs to such a range, generally, an operation head 7, which takes out a content liquid by means of a nozzle-system, is mounted. As shown in FIG. 2 (B), the piston pipe 3 is of a type which is provided with a resilient force restoring mechanism 16 wherein a restoring action force directed in an upward direction is applied to the piston pipe 3. A connecting pipe 3*a* is disposed between the piston pipe 3 and a suction pipe 9. Further, between the piston pipe 3 and the suction pipe 9 or in the inside of the piston pipe 3, a ball valve or other check valve 6 is disposed.

In this embodiment, the operation head 7, which is mounted on the piston pipe 3 which functions as the outlet connected to the suction pipe 9 of the commercially available perfume container 8 shown in FIG. 1, is removed. Then, as shown in FIG. 2, a split-injection operation head 2 which is formed at one end of a split-injection pipe 1 of the split injection implement 10 is mounted on the above-mentioned piston pipe 3. It is preferable that an engaging opening 21 is formed in multiple stepped stages consisting of two or more stages such as engaging steps 21*a*, 21*b* which are formed in a concentric manner.

Figure 2B:
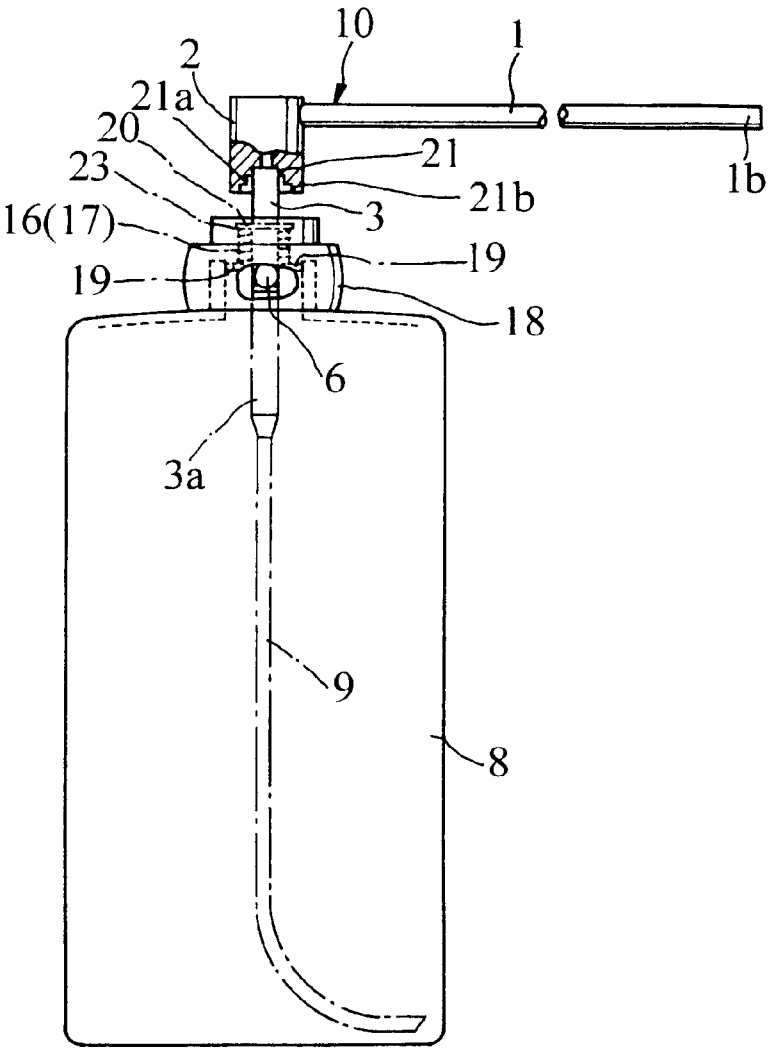
FIGS. 2(A) and 2(B) are front views with a part broken away of one example of a dispensing implement of the invention mounted in the condition that the implement is mounted on the commercially available perfume container of FIGS. 1A and 1B.
Figure 2A:
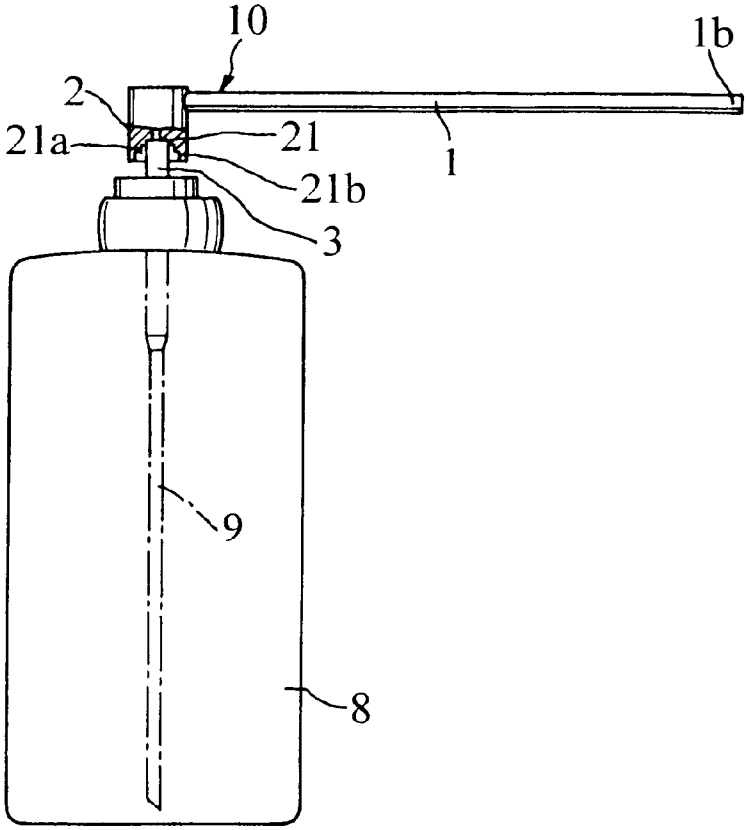

To the piston-pipe 3 of the commercially available perfume container 8 shown in FIGS. 2(A) and 2(B), the suction pipe 9 which extends downwardly into the inside of the container 8 is connected. As is known, a valve or a flexible valve 6 which substitutes for the ball valve 6 shown in FIGS. 1(A) and 1(B) is mounted on the suction pipe 9 at a position close to the piston pipe 3. Further, due to an action of a resilient member 17 set on a stopper portion 19 formed on the inside of a lid portion body 18 in a protruding manner, a flange portion 23 which is formed in a middle portion of the piston pipe 3 constantly receives an upward push action force such that the flange portion 23 is brought into contact with an upper stopper portion 20 of the lid portion body 18. By pushing down the operation head 7 (or the exchanged split-injection operation head 2), a given amount of the perfume or the like stored in a portion above the valve 6 portion is instantaneously sprayed. Furthermore, since the resilient force restoring mechanism 16 including the above-mentioned resilient member 17, the flange portion 23 and a stopper portion 19 is restored after the above-mentioned pushing, the inside of the suction pipe 9 becomes at a negative pressure and the perfume in the inside of the perfume container 8 is sucked.

In the invention, as mentioned previously, the operation head 7 mounted on the piston pipe 3 which functions as the outlet of the above-mentioned commercially available perfume container 8 is removed and then the split-injection operation head 2 shown in FIGS. 2(A) and 2(B) which is prepared separately is mounted. By pushing down the split-injection operation head 2 mounted in this manner against the action force of the resilient force restoring mechanism 16, the valve 6 which works as the check valve of the above-mentioned suction pipe 9 is operated so that the perfume or the like in the inside of the suction pipe 9 can be taken out from the split-injection operation head 2 by way of the split-injection pipe 1.

The above-mentioned resilient force restoring mechanism 16 may adopt a structure shown in FIGS. 7(A)–7(C) or FIG. 8 as a mechanism suitable for being set in the inside of the particularly small and narrow-diameter suction pipe 9 and the piston pipe 3 is pushed downwardly. That is, in connecting the lower end of the piston pipe 3 to the upper end of the suction pipe 9, an upper end side of the suction pipe 9 is enlarged in diameter to form a storing portion 9*a* for storing a ball valve element 26 and a resilient spring 16*a*. A bulged portion 24 is formed on the enlarged-diameter portion 22 and a through hole 25 is formed in a lower end portion of the piston pipe 3 so that when a through hole 25 portion is pushed downwardly and the portion passes the enlarged-diameter portion 22, the perfume in the inside of the suction pipe 9 is flown into the inside of the piston pipe 3 by way of steps shown in FIGS. 7(A), 7(B) and 7(C).

Figure 7A:
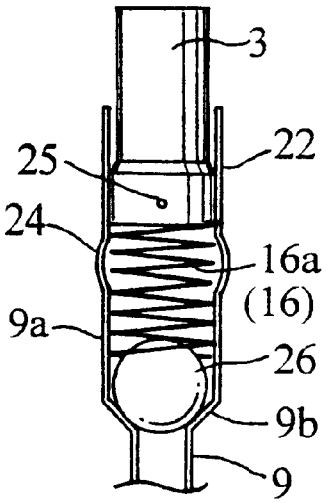
FIGS. 7(A)–7(C) are explanatory views showing the operational relationship in stages of one example of a check valve mechanism of the invention, which has a relatively simple constitution.
Figure 7B:
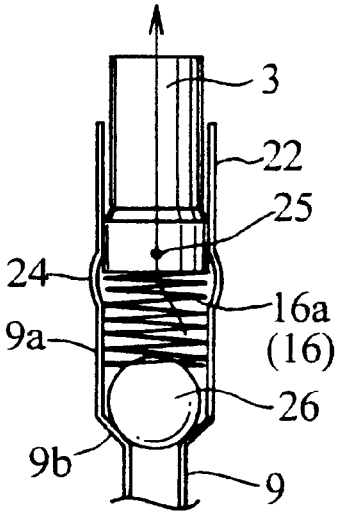
Figure 7C:
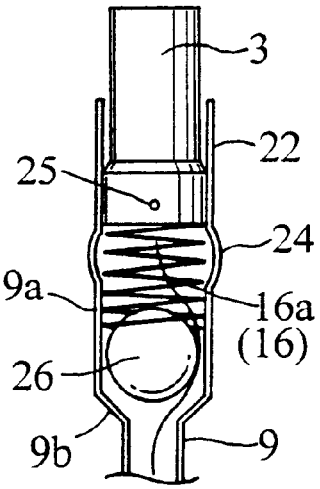
Figure 8:
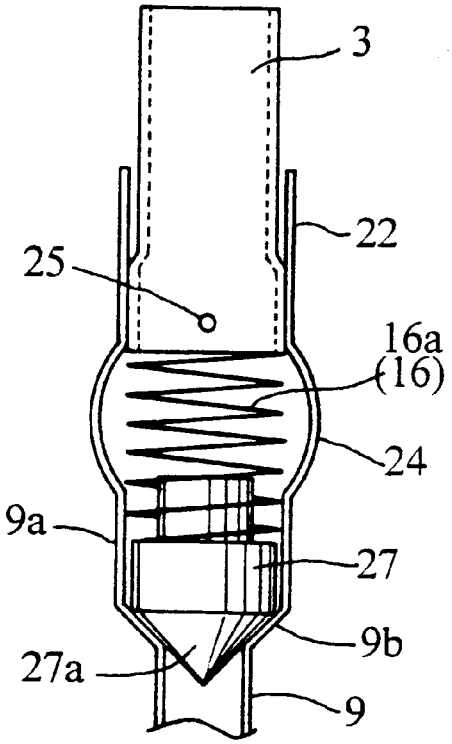
FIG. 8 is a partial explanatory view showing an essential part when a needle valve is used in the check valve mechanism shown in FIGS. 7A–7(C).

Although the resilient force restoring mechanism 16 shown in FIGS. 7(A)–7(C) adopts the ball body as the valve element 26, the resilient force restoring mechanism according to the invention may adopts a valve element 27 which forms a needle portion 27*a* on a lower end portion thereof as shown in FIG. 8. With such a constitution, a similar operation can be achieved. That is, a small and simple valve mechanism can be provided by making use of the connection structure between the pipe-like members 3, 9.

The perfume or the like taken out by the split-injection pipe 1 may be received by a split-injection container 5 corresponding to the preference of each person. That is, a spout 1*b* of the split-injection pipe 1 which is provided with a bent portion in a middle portion thereof is directed downwardly and then, in a state that the spout 1*b* is inserted into the split-injection container 5, the split-injection operation can be performed by pushing the operation head 2 downwardly.

Accordingly, a proper amount of perfume or the like can be easily and properly split-injected and the discharge of the perfume or the like to the outside of the container can be prevented thus ensuring the safe dispensing of the perfume or the like.

As a commercially available perfume container 8, the perfume container shown in FIGS. 1(A) and 1(B) and FIGS. 2(A) and 2(B) is illustrated as a typical example of a perfume container having a simple configuration. It is needless to say, however, that commercially available perfume containers 8 which are adopted by respective makers conventionally and to which versatile designs are applied can be directly adopted. A purchaser or a user can perform the above-mentioned split-injection operation from such a commercially available perfume container 8 so as to dispense the perfumes or the like. It is also possible for a sales store or the like to perform the split-injection and sell the perfumes or the like. In this case, it is unnecessary to adopt the commercially available containers to which special designs are applied. Further, even when simple containers shown in FIGS. 1(A), 1(B), 2(A) and 2(B) or cylindrical containers may be used, it hardly gives rise to any problem in terms of display and selling. That is, it is sufficient if the sales stores can confirm the quality of perfumes or the like stored and hence, by using a piece of adhesive paper on the cylindrical container or the like, the quality of the perfumes or the like which is the content can be sufficiently checked.

As the split-injection container 5 which can be adopted for the above-mentioned perfume container 8, containers which have been used conventionally as the commercially available perfume containers can be directly used. By directly adopting the commercially available perfume containers in this manner, advantages such as a gorgeous display and exhibition effect of the containers can be fully utilized. Further, according to the present invention, containers which are suitable for carrying such as a small cylindrical container 5 and a flattened container shown in FIG. 3 and FIGS. 5, 6, for example, may be adopted as the split-injection container 5. The small cylindrical container and flattened container are not specifically bulky and five or more containers can be carried while storing them in the handbag without any difficulty. When the diameter of the cap 12 is set equal to that of the container 5, the container can ensure a stable stored state when stored in the handbag.

That is, since two or more split-injection containers 5 can be suitably carried, even in a journey or the like, the use of perfume or the like corresponding to the atmosphere which vary at a suitable time interval or respective sites becomes possible. Further, even in the inside of a vehicle or a train, it becomes possible to use the perfume by spraying every 2 3 hours.

Figure 3:
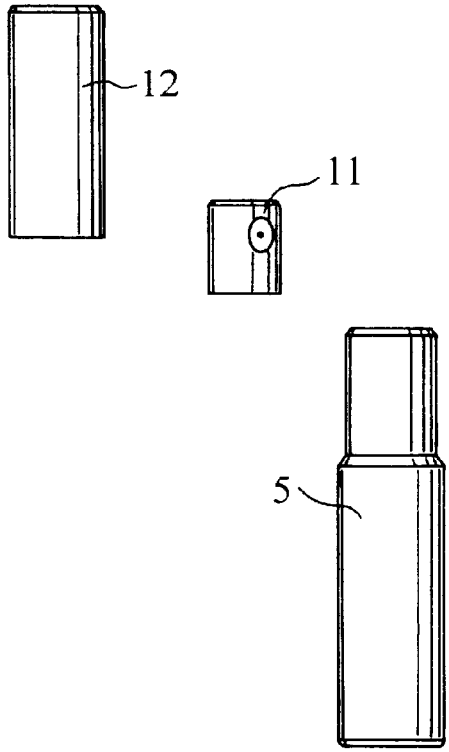
FIG. 3 is an exploded side view showing one example of a split-injection container used in the invention.
Figure 4:
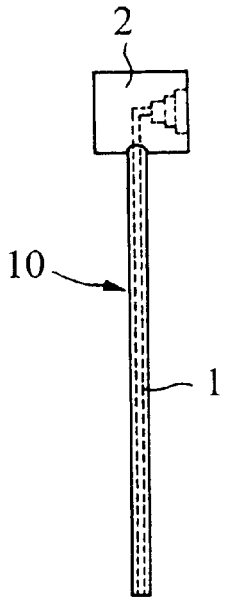
FIG. 4 is a side view showing one example of the split-injection implement of the invention.

Accordingly, an ideal use condition of perfume or the like can be achieved. As shown in FIG. 3, a spray head 11 and the cap 12 can be mounted on the split-injection container 5. It is apparent that, in the state that the cap 12 and the spray head 11 are removed, by mounting a split-injection operation head 2 shown in FIG. 4 on the piston pipe 3 of the perfume container 8 as in the case of FIGS. 2(A) and 2(B), effective use can be obtained. In this manner, the container 5, which allows the mounting of the cap 12, protects the spray head 11. Further, since the whole constitution of the container 5 becomes a simple cylindrical shape, the container 5 is prevented from becoming bulky when stored in a handbag. Still furthermore, the container 5 can take the stable stored state when stored in the handbag; it is preferable to carry a plurality of containers 5 while storing them in the handbag.

Figure 5:
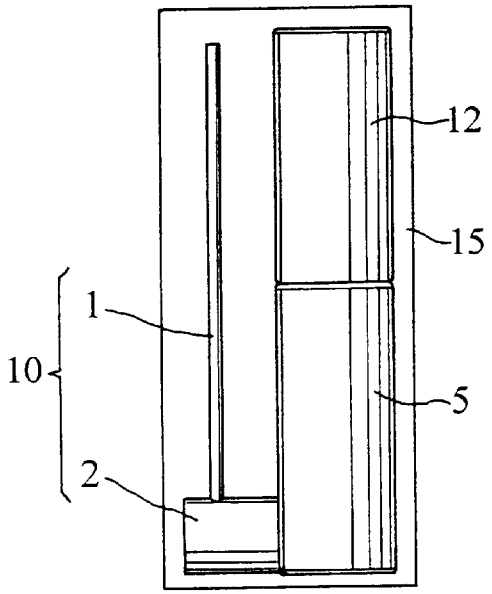
FIG. 5 is a plan view showing an example of a packaging and storing body which is a combination of the split-injection container and the split-injection implement shown in FIG. 4 which are used in the invention.
Figure 6:
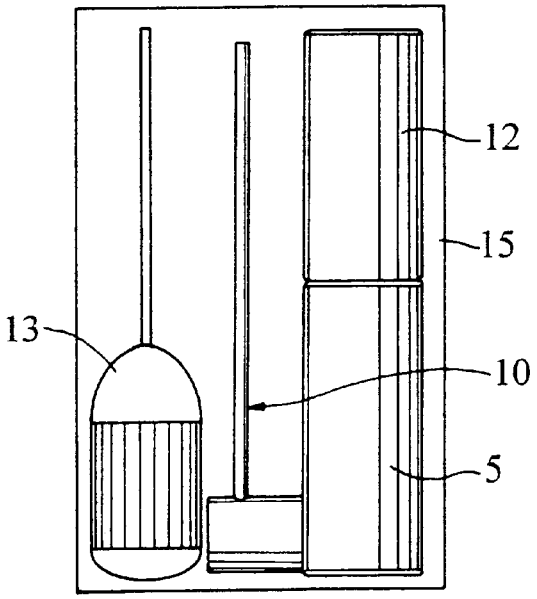
FIG. 6 is a plan view showing a packaging and storing body which is another combination of the split-injection container and the split-injection implement of the invention.

Further, the invention proposes an idea to sell or handle the above-mentioned split-injection implement 10 and the split-injection container 5 as a set. This mode is shown in FIG. 5 and FIG. 6. That is, FIG. 5 shows a case where the above-mentioned split-injection container 5 and the split injection implement 10 are stored in a packaging and storing body 15 as a set. By using a transparent material body as the packaging and storing body 15, the contents can be properly recognized as shown in the drawings.

Further, according to the invention, the packaging and storing body 15 is constituted by further adopting a dropping-pipette type implement 13 shown in FIG. 6 as the split-injection implement 10. When the commercially available perfume container 8 is a simple container which is not provided with the suction pipe 9, the valve 6 and the operation head 7, it is apparent that, with the use of this dropping-pipette type implement 13, the perfume or the like can be easily and properly sucked, dispensed and then is injected into the above-mentioned container 5 or the like. Accordingly, the set shown in FIG. 6 has an advantage that the set can adopt a wide variety of commercially available perfume containers.

Although the packaged sets shown in FIG. 5 and FIG. 6 become bulky by the volume of the packaging and storing container 15, by storing a plurality of part bodies in a packed state, the bulkiness substantially hardly exits. Accordingly, it is apparent that it becomes possible to obtain an advantageous effect that the takeout and storing operation of the part bodies can be integrally achieved so that the operation becomes easy and that it becomes possible to prevent the inside of the handbag from becoming in a disordered state.

In the above mentioned manner, in the perfume dispensing implement, the engaging portion to be fitted onto the outlet of the container which stores perfume or toilet lotion is formed in multiple stepped stages. Simultaneously, the push operation head having the outlet hole, which is opened, at the center of the engaging portion is provided. Further, the dispensing pipe is connected to the outlet hole. Accordingly, the perfume dispensing implement can be connected to the outlets of versatile containers so that the dispensing of perfumes from respective containers becomes possible using the same perfume dispensing implement. Accordingly, perfume or the like can be separately stored in containers suitable for carrying so that a plural kinds of perfumes or the like can be used in a journey or the like, thus realizing the proper utilization of the perfumes or the like.

By forming the engaging portion to be fitted into the outlet (or piston pipe) of the container using a proper resilient material and concentrically forming the engaging portion in three stepped stages, the engaging portion is detachably mounted on the outlet of the container in a suitably deformed manner. Further, the takeout operation, which can promptly respond to the change of outlets of a considerably versatile container, becomes possible so that the dispensing of perfumes or the like for substantially all commercially available perfumes or the like can be realized. For example, the outlets of containers which receive these kinds of perfumes or the like generally have a pipe-like shape and hence, by providing a contact mounting which makes use of the inner and outer surfaces of an engaging portion which are formed in concentric steps of three stages, the engaging portion can promptly respond to 5–6 kinds of outlet changes. Further, by respectively forming inner and outer surfaces of the engaging portion having steps of three stages into inclined surfaces, the engaging portion can promptly respond to a large number of outlet changes.

By forming the outlet hole in the side surface of the engaging portion to be fitted into the outlet of the container and by bending the middle portion of the dispensing pipe which is connected to the outlet hole downwardly, the perfume or the like which is dispensed is discharged downwardly so that injection of the perfume or the like into the opening portion of the container which receives the perfume or the like can be easily and properly performed.

A perfume container may also be provided which includes a plug body connected to a suction pipe at an opening portion of a glass container whose length is greater than a diameter thereof, with an upper end of the suction pipe opened at the center of the plug body, and with a push operation head detachably mounted to the opening portion. By storing such a perfume container and the above-mentioned perfume dispensing implement in a storing body, a container which stores the dispensed perfume can be prepared together with the above-mentioned dispensing implement so that the above-mentioned dispensing of perfume and the carrying of perfumes in the inside of the handbag with the use of the above-mentioned perfume container can be properly performed.

By also storing a dropping-pipette type implement in which a top face closing operation portion having reinforcing longitudinal lines disposed on a side surface thereof is formed on an upper end of a suction pipe in a storing body, perfume or the like which is stored in the inside of a container which has no push operation head can be dispensed into a separate container in the same manner as mentioned above and hence, the above-mentioned use of perfume becomes possible.

By providing a check valve such as a ball valve in a flow passage which is formed in the inside of an outlet of a container in which perfume or the like is stored and is connected to the container by way of the suction pipe, providing a detachable operation head to an end portion of the flow passage, and making an inner hole formed in the operation head opened at a side surface of the operation head, and connecting a split-injection pipe to the opening portion, the dispensing of perfume or the like from respective containers becomes possible whereby the perfume or the like can be split-stored in containers suitable for carrying perfumes or the like and the perfumes or the like are preferably used during a journey.

By providing a valve seat and a flexible valve element in a flow passage which is formed in the inside of an outlet of a container in which perfume or the like is stored and is connected to the container by way of the suction pipe, providing a detachable operation head to an end portion of the flow passage, and making an inner hole formed in the operation head opened at a side surface of the operation head, and connecting a split-injection pipe to the opening portion, the dispensing of perfume or the like from respective containers becomes possible, thus enabling the advantageous use of the perfume dispensing implement.

By providing a valve seat and a ball valve or other valve element which interposes a resilient member in a flow passage which is formed in the inside of an outlet of a container in which perfume or the like is stored and is connected to the container by way of the suction pipe, providing push-down means having an operation head to the valve element and the resilient member, the smooth dispensing of the perfumes can be realized with a relatively simple and compact constitution by making use of the piston pipe provided with the push-down means.

The push-down means having the operation head is constituted by a piston pipe and one end portion of the piston pipe is mounted in a suction pipe and a valve seat for a ball valve or other valve element is formed in the suction pipe and hence, the smooth dispensing of the perfumes can be realized with a relatively simple and compact constitution by making use of the suction pipe and the piston pipe provided with the operation head.

The above-mentioned perfume dispensing implement and the cylindrical split-injection container are stored in the packaging and storing body and hence, the container for storing the dispensed perfume can be prepared together with the above-mentioned dispensing implement whereby the above-mentioned dispensing and the portable use of the perfumes stored in the handbag with the use of the above-mentioned perfume container can be achieved properly.

By storing a dropping-pipette type dispensing implement which forms a flexible push portion having protruding ridges and grooves on an operating portion in a storing body together with a perfume dispensing implement and a cylindrical split-injection implement, perfume or the like stored in the inside of a general type container having no push operation head can be dispensed into such other container using this dropping-pipette type dispensing implement.

INDUSTRIAL APPLICABILITY

As has been explained heretofore, according to the present invention, under the condition that the perfume or the like in the commercially available perfume container is sucked by means of the suction pipe for spraying the perfume or the like which is mounted on the commercially available perfume container, the dispensing pipe is mounted suitably and the perfume or the like in the inside of the commercially available perfume container is suitably dispensed by each user or each sales shop, whereby the advantageous sale, use and operation of perfumes or the like are realized.

In the claims:

1. A perfume dispensing implement set comprising:

a portable container whose length is greater than a diameter thereof and which includes an opening portion into which a plug body is inserted, wherein said plug body is connected to a first suction pipe whose upper end is opened at a central portion of the plug body;

a perfume dispensing element comprising a push operation head including a first engaging portion adapted to be fitted onto an outlet of a perfume container from which an original operation head has been removed, and a second engaging portion having an outlet hole at a central portion thereof, wherein a dispensing pipe is connected to the outlet hole and the dispensing pipe includes a bent portion in a middle portion thereof, and wherein said first engaging portion is made out of a resilient material and is formed in multiple stepped stages; and a storing body in which said portable container and said perfume dispensing element are storable.

2. A perfume dispensing implement set according to claim 1, further comprising a dropping-pipette type dispensing implement including a second suction pipe and a top face closing operating portion formed on an upper end of the second suction pipe, wherein said top face closing operating portion has reinforcing longitudinal lines disposed on a side surface thereof, and wherein said dropping-pipette type dispensing implement is also storable in the storing body.

* * * * *